United States Patent [19]

Murphy et al.

[11] 4,423,309

[45] Dec. 27, 1983

[54] QUICK HEAT SELF REGULATING ELECTRIC GLOW HEATER

[75] Inventors: Michael P. Murphy, Flint; Gary F. Stack, Grand Blanc; James W. Hoppenrath, Flint; John R. Taylor, Lapeer, all of Mich.

[73] Assignee: General Motors Corporation, Detroit, Mich.

[21] Appl. No.: 392,600

[22] Filed: Jun. 28, 1982

[51] Int. Cl.[3] ..... F23Q 7/22

[52] U.S. Cl. ..... 219/270; 123/145 A; 219/260; 361/266; 338/218; 338/239

[58] Field of Search ..... 219/260, 267, 270, 552; 361/264, 265, 266; 338/218, 239; 123/145 R, 145 A; 431/262; 29/611

[56] References Cited

U.S. PATENT DOCUMENTS

| | | | |
|---|---|---|---|
| 1,751,416 | 3/1930 | Musgrove | 338/239 |
| 2,130,365 | 9/1938 | Paulson | 123/145 A |
| 2,492,755 | 12/1949 | McCollum | 219/270 X |
| 3,158,787 | 11/1964 | Testerini | 361/266 X |
| 4,112,577 | 9/1978 | Mann | 29/611 |
| 4,211,204 | 7/1980 | Glauner et al. | 123/145 A |
| 4,351,291 | 9/1982 | Mahoney | 123/145 A |

FOREIGN PATENT DOCUMENTS

| | | | |
|---|---|---|---|
| 1089307 | 11/1980 | Canada . | |
| 1148110 | 6/1958 | Fed. Rep. of Germany | 123/145 A |
| 254482 | 7/1926 | United Kingdom | 123/145 A |
| 1127454 | 9/1968 | United Kingdom . | |
| 1215013 | 12/1970 | United Kingdom | 361/266 |
| 2013277 | 8/1979 | United Kingdom | 361/266 |

*Primary Examiner*—Volodymyr Y. Mayewsky
*Attorney, Agent, or Firm*—Robert J. Outland

[57] ABSTRACT

A sheathed electric heater especially of the type used as diesel engine glow plugs has a dual coil heating element including separate tip heater and PTC body control coils thermally isolated by a low resistance connector section made from interengaging small diameter coiled connector portions integral with the tip and body coils and preferably welded together. Preferred material and dimensional specifications and pertinent design considerations are also included.

8 Claims, 3 Drawing Figures

QUICK HEAT SELF REGULATING ELECTRIC GLOW HEATER

TECHNICAL FIELD

This invention relates to sheathed electric heaters of the type used for example as diesel engine glow plugs. In its more particular aspects, the invention relates to a fast-heating self-regulating electrical resistance glow plug heater for diesel engines and the like.

BACKGROUND

It is known in the art relating to diesel engines to provide electrically heated glow plugs in the combustion or precombustion chambers where fuel is injected to aid in igniting the fuel during starting and cold engine operation. Many types of such glow plugs have been utilized, each having its attendant operational characteristics.

Simple constant resistance heaters when used without additional controls were subject to the objection of excessive warm-up time, often more than one minute, before the glow plugs reached an operating temperature adequate to permit engine starting. This waiting time has been greatly reduced by present systems combining fast heating glow plugs with control devices that interrupt or modulate current flow to maintain the operating temperature in a desired range once it has been reached. Such systems operate effectively but are subject to the objection of added cost and complexity.

Some engine makers have favored self regulating type glow plugs whose heating coils are made of material having a positive temperature coefficient of electrical resistance (PTC) that allows somewhat faster warm-up while limiting the ultimate operating temperature through increasing resistance of the coil with increasing temperature. Dual coil glow plugs have also been developed in which a heating coil at the tip is connected in series with a PTC coil in the heater body to provide somewhat improved performance. However these systems have usually compromised the rapid warm-up capabilities and/or the glow plug durability characteristics of the fast heat control systems.

Our studies of prior PTC and dual coil glow plug designs have found that durability problems have resulted in part from the limited temperature capability of the PTC material, which is subject to oxidation at the operating temperatures required to obtain satisfactory starting of prechamber type indirect injection diesel engines. In some dual coil designs excessive temperatures of the PTC coil have arisen from physical adjacency to the high temperature heater or glow coil in the tip as well as from the selection of wire sizes and materials made to promote fast heating of the glow plug. Typically such designs must be shut off within a few seconds after they reach operating temperature in order to avoid operation at excessive temperatures which would seriously impair their life. Also, close connection of the coils causes early regulation by the PTC coil that reduces current flow too soon and delays warm-up of the heater coil to its desired operating temperature. Another problem we have discovered in some dual coil designs is connection of the coils through adjacent single wires with a very small weld and in a manner that causes high resistance and locally high operating temperatures leading to early failure.

SUMMARY OF THE INVENTION

The present invention comprises an improved dual coil glow plug, or sheathed heater, construction which provides significantly improved operation while solving many of the problems found in prior art glow plug constructions. A sheathed heater, or glow plug, according to the present invention includes series connected dual tip and PTC body coils of resistance wire or material as is found in certain prior glow plug arrangements. It differs however in many features including the selection and sizing of resistance wire materials and construction features to provide a desired combination of rapid warm-up and ultimate temperature control with extended durability.

Among other features, the present invention provides relative thermal isolation of the PTC body coil from both the higher temperature tip coil at one end and the relatively cool shell which supports the sheathed heater at its other end. This isolation is sufficient to enable the body coil to determine its operating temperature largely through self produced heat and thus provide a desired increase in resistance to limit itself to an operating temperature cool enough to provide long durability of the coil.

The resistances of the tip and body coils are preferably selected with a correct ratio to provide a desired fast rate of heating of the tip with subsequent regulation of maximum current to prevent overheating the tip and PTC coils during extended afterglow operation. This requires proper selection of the initial and final resistances considering the thermal mass and surface area surrounding each coil.

In a further feature, the tip and body coils are connected through a large surface area providing a massive low resistance connection of relatively high conductivity to minimize heat production and oxidation at the connecting points. In preferred embodiments the construction provides an extensive welded connection of a portion preferably comprising inter-engaging small diameter coils extending from the adjacent ends of the tip and body coils and secured together by welding and, preferably, also mechanical engagement.

These and other features and advantages of the present invention will be more fully understood from the following description of a preferred embodiment taken together with the accompanying drawings.

BRIEF DRAWING DESCRIPTION

DETAILED DESCRIPTION

Figure 1:
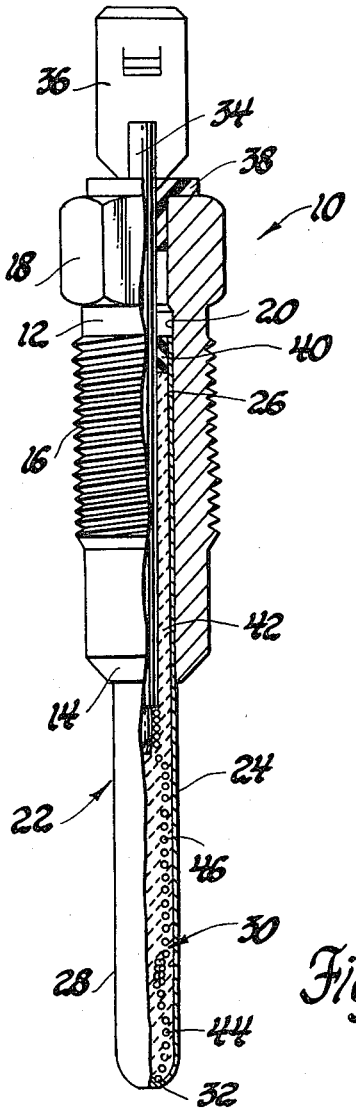
FIG. 1 is a partial cross-sectional view of a glow plug having a heater assembly formed in accordance with the invention.

Referring now to the drawings in detail, numeral 10 generally indicates a diesel engine glow plug having the features of the present invention.

Glow plug 10 includes a conventional metal outer shell 12 having a conical sealing surface 14 at one end, a threaded portion 16 intermediate the ends and a hexagonal head 18 at the end opposite the sealing surface. The shell includes a longitudinal bore 20, in the lower portion of which there is tightly fitted a sheathed heater assembly formed in accordance with this invention and generally indicated by numeral 22.

Heater assembly 22 includes a tubular metal sheath 24 having an open end portion 26 fixed within the bore 20 and an elongated closed end portion 28 extending outwardly of the shell along the axis of the bore 20.

Centered within the sheath is a longitudinally extending dual coil electrical resistance heating element 30, one end 32 of which is electrically connected to the sheath at its closed end. The heating element extends from the closed end of the sheath up to about its center, at which point it is attached to the end of a center rod or terminal 34. The terminal extends out through the open end of the sheath 24 and through the bore 20 out the hex headed end of the shell 12. A terminal blade 36 is affixed to the exposed end of the center terminal to receive an electrical attaching clip.

The terminal 34 is centered within and insulated from the shell 12 and the sheath 24 by a phenolic insulator 38 between the terminal and shell and a compressed rubber O-ring 40 between the terminal and the open end of the sheath. The remaining space within the sheath is filled with a suitable heat transmitting electrical insulating material 42, such as compressed granulated or powdered magnesium oxide, which holds the heating coil and the terminal in their centered positions within the sheath and prevents electrical contact between them except at the intentionally joined point at the closed end of the sheath.

Figure 2:
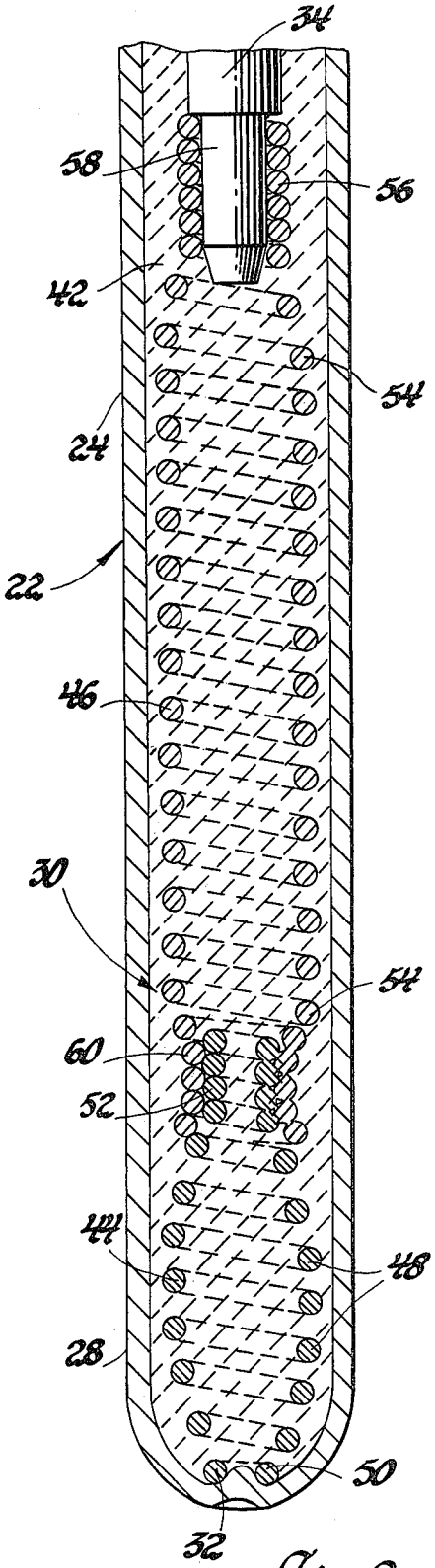
FIG. 2 shows an enlarged cross-section of the heater assembly of the glow plug of FIG. 1.

The heating element 30 as best shown in FIG. 2 is a so-called dual coil element formed of two distinct coils, a glow or heater tip coil 44 and a regulating PTC body coil 46. The tip coil 44 is formed of a high temperature resistant wire material such as, for example, Nichrome V, a trade name for an alloy of essentially 80% nickel and 20% chromium. The main heat producing part of the tip coil is an enlarged central portion 48 having a plurality of relatively large diameter helical coils. These merge at one end with a downwardly tapered end portion 50 of progressively smaller coils that engage and are welded to the end of the sheath at 32. At the other end, the tip coil has an integral closely wound extension of small diameter closed coils, providing a connector portion 52 for connection with the body coil.

The body coil 46 is formed of a positive temperature coefficient (PTC) wire material such as for example Hytemco, a trade name for an alloy of 72% nickel and 28% iron. The main control and heat producing part of the body coil is an enlarged central portion 54 with a plurality of relatively large diameter helical coils. Adjacent this an inner end portion 56 tapers down through progressively smaller coils to a closely wound portion of smaller coils that slides over a reduced diameter end 58 of the terminal rod 34 and is preferably welded thereto to provide a secure mechanical and electrical connection. At the other end of the body coil is a connector portion 60 comprising a plurality of reduced diameter coils which are sized to fit closely around the small diameter coils comprising the connector portion 52 of the tip coil.

Preferably both coils and their connector portions in particular are wound in the same direction with the tightly coiled connector portions having the same lead. Thus, when properly sized, the connector portions can be threaded together to form a nesting set of inner and outer connecting coils that define a multiple coil connector section between the main heating portions of the two coils. Optionally, however, the connector portions can be sized to fit closely together when one is inserted into the other without threading and, in this case, the coils may be wound in either the same or opposite directions.

The engaging coils of the tip and body coil connector portions of the heating element preferably are permanently joined by welding the multiple wrapped coils together in a manner to provide an extensive area of electrical contact between the coils and give a low resistance electrical connection through a relatively large mass of connecting conductive weld and wire. This low resistance connection amd the increased area for current flow provided by it limits the production of heat due to current flow through the connector section between the tip and body coils and thereby provides a cooler operating long life welded connection as will be subsequently more fully described.

DESIGN CONSIDERATIONS

The design of a heater or glow plug to take greatest advantage of the features of the present invention in a particular application naturally requires proper selection of materials and dimensional specifications. Suitable choices may be arrived at in the course of development using known materials and available design and test procedures. For automotive glow plug applications we prefer to form the sheath of a heat resistant nickel based super alloy, preferably Inconel 601, a trade name for an alloy composed nominally of about 60.5% nickel, 23% chromium, 14.1% iron, 1.35% aluminum, 0.05% carbon and a maximum of about 0.5% copper.

The PTC body coil we prefer to form of Hytemco (trade name for an alloy of 72% nickel and 28% iron) although commercially pure nickel wire may also be used. Hytemco is more desirable since its resistivity is twice as high as nickel with nearly the same temperature coefficient of resistance (TCR). This permits the use of larger size wire in the coil which may be more easily handled in production.

The tip heater coil we prefer to make from Nichrome V (trade name for an alloy of 80% nickel and 20% chromium) which we find more durable than some other alternate material choices.

The selection of dimensions for the various components and their relative positioning in the assembly is to some extent a matter of choice. Computer simulation of various glow plug warm-up and operating conditions can be accomplished by calculations that take into account the thermal masses of the tip and body sections of the glow plug, the heat energy added to each section with respect to time and the heat lost from each section with respect to time by convection, conduction and radiation.

Such simulation can aid in choosing the proper coil dimensions and resistance values to obtain desired operating temperatures of the tip and body portions of the glow plug. The minimum tip temperature is determined by the starting requirements of the engine while the maximum body temperature adjacent the body coil is preferably lower than that of the tip to promote durability of the body coil itself through avoidance of excessive oxidation.

Durability of the body coil is also aided by maintaining reasonable thermal isolation of adjacent ends of the heat producing portions of the tip and body coils by providing a substantial nonheated space between them. In the preferred embodiment illustrated, this thermal isolating space is provided by the length of the coil connecting section which extends for a longitudinal distance roughly equivalent to the outer diameter of the glow plug sheath. Because of the low resistance connection afforded by the joined coil connecting portions in the coil connecting section, the glow plug current passes through this section without developing any significant amount of heat therein. Thus this isolating section of the plug acts to dissipate heat transmitted to it from both the tip and body coils while providing a restriction to conductive heat flow between them.

Preferably the isolating space between heat producing portions of the coils will be limited to avoid forming an excessive length for dissipating heat from the tip and slowing its warm-up. Considering the various effects, it is thought preferable for a glow plug of the type described if the length of the isolating space between the heat producing coil portions falls within a range of from 50% smaller to 50% larger than the adjacent outer diameter of the glow plug sheath.

The construction of the described embodiment is such that upon installation of the glow plug in an engine with appropriate electrical connections, a current may be passed from the blade 36 through the terminal 34 and the dual heating element 30 to the closed end of the sheath 24 and therethrough back to the shell 12 which is grounded to the engine, causing the heating element to raise to operating temperature the exposed end of the sheathed heater assembly.

Table I lists nominal specifications for components of a glow plug exemplifying the illustrated embodiment of the present invention.

TABLE I

| Characteristic | PTC Body Coil | Tip Heater Coil |
|---|---|---|
| Material | Hytemco | Nichrome V |
| Wire size | 28 gage-.0125 in. | 28 gage-.0125 in. |
| Length | .65 in. | .25 in. |
| Resistance cold | .30 ohm | .70 ohm |
| Power cold | 40 watts | 93 watts |
| Resistance hot | 1.3 ohms | .7 ohms |
| Power hot | 43 watts | 23 watts |
| Insulation material | MgO powder | |
| Sheath material | Inconel 601 | |
| Sheath outer diameter | 5 mm | |
| Nominal coil spacing | 5 mm | |

Figure 3:
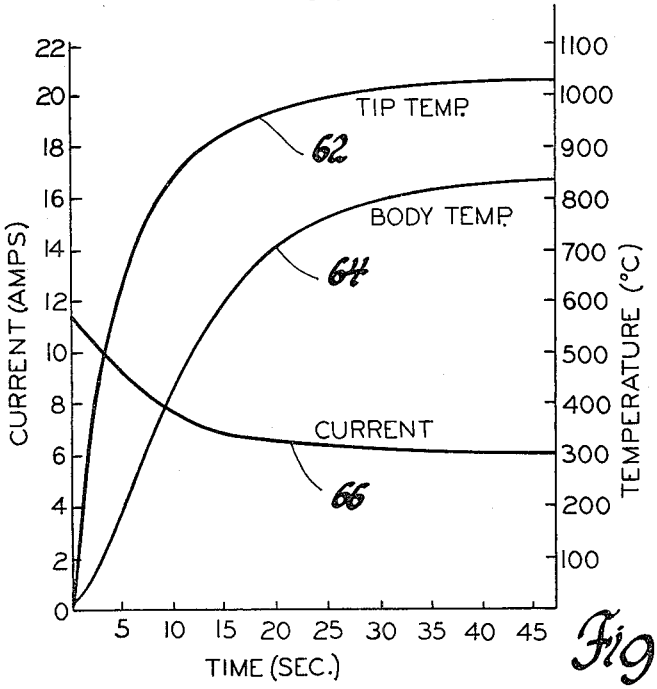
FIG. 3 is a graphical presentation representative of warm-up test data from a specific embodiment of glow plug according to the invention.

Warm-up and control characteristics for a glow plug having substantially the specifications listed in Table I are shown in FIG. 3. The tip and body temperatures resulting over a period of 45 seconds of heat up to near the controlled operating temperatures are shown respectively by lines 62 and 64. The indicated tip and body temperatures are as measured on the surface of the sheath at the midpoints of each coil with a voltage of 11.5 volts applied to the terminals. The resulting current flow is shown by line 66. It will be noted that the temperature of the tip climbs rapidly, reaching 850° C. in about ten seconds and levels off at a temperature slightly above 1,000° C. after 45 seconds of operation. The temperature of the body adjacent the PTC body coil climbs at a slower rate due to the relatively lower initial resistance of the body coil and relative thermal isolation from the tip coil.

As the temperature of the body coil increases, its resistance increases significantly so that the overall current drops off as shown in the figure, eventually reaching a relatively constant level of about six amps, down from an initial current of about 11 and ½amps. This results in a leveling off of the temperatures in the body and tip. By reason of the glow plug design, including resistance and heat dissipating area, the temperature at the body adjacent the body coil levels off at about 830° C., a level at which extended operation of the PTC body coil material is possible without failure and considerably below the operating temperature of the tip as indicated in the figure.

It should be recognized that the fast warm-up characteristic of the glow plug is aided by making the mass of the sheathed heater portions surrounding the heating elements as small as possible. This is done in part by using a small sheath diameter of 5 mm where the glow plug application permits. In addition, the thermal mass of the tip portion surrounding the tip coil is made small relative to the body portion surrounding the body coil by selecting the materials and resistance to provide a tip coil of substantially shorter length with a relatively high power density. This permits fast warm-up of the tip portion to a fuel igniting temperature while slowing the rate of temperature increase of the body coil to delay the full effect of its regulating action until after the desired fuel ignition temperature of the tip has been reached.

While the invention has been described by reference to a specific embodiment chosen for purposes of illustration, it should be understood that numerous changes could be made without departing from the inventive concepts disclosed. Accordingly, it is intended that the invention not be limited to the described embodiment but that it have the full scope permitted by the language of the following claims.

The embodiments of the invention in which an exclusive property or privilege is claimed are defined as follows:

1. A self regulating electric resistance glow plug heater for engines or the like and of the type having an elongated electrically conductive tubular sheath having a closed end, a resistance glow coil in the sheath tip near the closed end and a PTC resistance regulating coil in the sheath body remote from the closed end, the coils being connected together at adjacent ends and the glow coil being connected with the sheath tip at the closed end, and electrical conductor means connecting with the regulating coil and the sheath to supply electric current to the coils to generate heat, heat conductive electrical insulation supporting the coils within the sheath and the improvement wherein the coils have spaced heat producing portions and the adjacent ends of the coils form connector portions that are of helical conformation and of reduced diameter relative to the adjacent heat producing portions of their respective coils, said reduced diameter helical connector portions being inserted one inside the other and closely fitted to connect the two coils over extended areas of the connector portions to provide thereby a low resistance, cool operating long life electrical connection between the coils.

2. A self regulating electric resistance glow plug heater for engines or the like and of the type having an elongated electrically conductive tubular sheath having a closed end, a resistance wire glow coil in the sheath tip near the closed end and a PTC resistance wire regulating coil in the sheath body remote from the closed end, the coils being connected together at adjacent ends and the glow coil being connected with the sheath tip at the closed end, and electrical conductor means connecting with the regulating coil and the sheath to supply electric current to the coils to generate heat, heat conductive electrical insulation supporting the coils within the sheath and the improvement wherein the coils have spaced multi-turn helical heat producing portions and the adjacent ends of the coils form connector portions that are of helical conformation and of reduced diameter relative to the adjacent heat producing portions of their respective coils, said reduced diameter helical connector portions being inserted one inside the other, closely fitted and secured together at extended areas of the connector portions to provide thereby a low resistance, cool operating long life electrical connection between the coils.

3. A self regulating electric resistance glow plug heater for engines or the like and of the type having an elongated electrically conductive tubular sheath having a closed end, a resistance wire glow coil in the sheath tip near the closed end and a PTC resistance wire regulating coil in the sheath body remote from the closed end, the coils being connected together at adjacent ends and the glow coil being connected with the sheath tip at the closed end, and electrical conductor means connecting with the regulating coil and the sheath to supply electric current to the coils to generate heat, heat conductive electrical insulation supporting the coils within the sheath and the improvement wherein the coils have spaced multi-turn helical heat producing portions and the adjacent ends of the coils form connector portions that are of helical conformation and of reduced diameter relative to the adjacent heat producing portions of their respective coils, said reduced diameter helical connector portions being inserted one inside the other, closely fitted and welded together at extended areas of the connector portions to provide thereby a low resistance, cool operating long life electrical connection between the coils.

4. A device in accordance with claim 1, 2 or 3 wherein the helical connector portions are wound in the same direction and with the same lead and are sized to provide threadable engagement of the inter-engaging connector portions with one another.

5. A self regulating electric resistance glow plug heater of the type having an elongated electrically conductive tubular metal sheath, closed at one end and containing a longitudinally extending self regulating dual coil heating element electrically grounded at one end to the sheath adjacent its closed end and insulated therefrom elsewhere by heat conductive electrical insulation, wherein said heating element comprises a quick heating tip coil and a current regulating PTC body coil connected in series and longitudinally spaced on a common axis within adjacent exposed tip and body portions respectively of the sheath, said tip coil being connected with and disposed near the closed end of the sheath and having a predetermined electrical resistance effective to heat the adjacent tip portion of the sheath to a desired normal operating temperature with a specified flow of electric current.

said body coil being connected with the tip coil on the end thereof away from the sheath closed end and having a positive temperature coefficient of electrical resistance effective to provide said specified current flow at a body portion temperature substantially below that of said prescribed tip portion operating temperature and to provide substantially higher current flow for fast warm-up of the tip coil at lower operating temperatures, said PTC body coil being connected to the tip coil by an electrical connection of much lower resistance than an equivalent length of either coil so as to minimize heat generation in the connection, and the high resistance, heat producing, portions of said tip and body coils being spaced apart a substantial distance by said low resistance connection to thermally isolate the coils and limit the transfer of heat from the tip coil to the lower temperature body coil to thereby enhance the operating durability of the PTC body coil.

6. A self regulating electric resistance glow plug heater of the type having an elongated electrically conductive tubular metal sheath, closed at one end and containing, entirely within an exposed portion of the sheath, a longitudinally extending self regulating dual coil heating element electrically grounded at one end to the sheath adjacent its closed end and insulated therefrom elsewhere by heat conductive electrical insulation wherein said heating element comprises a quick heating tip coil and a current regulating PTC body coil connected in series and longitudinally spaced on a common axis, said tip coil having an integral end connector portion of small diameter closely wound helical coils and a larger diameter helical heating portion connected with and disposed near the closed end of the sheath and having a predetermined electrical resistance effective to heat the adjacent tip portion of the sheath to a desired operating temperature with a specified flow of electric current, said body coil having an integral end connector portion of small diameter closely wound helical coils and a larger diameter helical control and heating portion connected with the tip coil on the end thereof away from the sheath closed end and having a positive temperature coefficient of electrical resistance effective to provide said specified current flow at a body portion temperature substantially below that of said prescribed tip portion operating temperature and to provide substantially higher current flow for fast warm-up of the tip coil at lower operating temperatures, the connector portions of said tip and body coils being fitted closely one inside the other to connect the two coils over extended surface areas of the connector portions and thereby provide a low resistance electrical connection that minimizes heat generation, and the high resistance, heat producing, portions of said tip and body coils being spaced apart a substantial distance by said low resistance connection to thermally isolate the coils and limit the transfer of heat from the tip coil to the lower temperature body coil to thereby enhance the operating durability of the PTC body coil.

7. A device in accordance with claim 5 or 6 wherein said distance between heat producing portions of the tip and body coils falls within a range of from 50% smaller to 50% larger than the adjacent outer diameter of said tubular sheath.

8. A self regulating electric resistance glow plug heater of the type having an elongated electrically conductive tubular metal sheath, closed at one end and containing a longitudinally extending self regulating dual coil heating element electrically connected to said sheath substantially at said end and insulated therefrom elsewhere by heat conductive electrical insulation, wherein said heating element comprises a quick-heating tip coil adjacent said one end and a current regulating PTC body coil electrically connected in series with the tip coil and located more remote from said end than the tip coil, said tip coil having a predetermined electrical resistance and effective power density such as to rapidly heat the exposed tip portion of the sheath to a fuel-igniting temperature, said body coil having a positive temperature coefficient of electrical resistance effective to reduce current flow through the tip coil primarily in response to self-heating due to current flow, the thermal inertia of the tip coil and adjacent tip portion being small in relation to the thermal inertia of the body coil and adjacent body portion and the two coils being thermally separated over a distance not less than one-half the adjacent outer diameter of said tubular sheath by a low temperature electrical connection having much lower resistance than an equivalent length of either coil, such that during warm-up the tip coil reaches a temperature facilitating fuel ignition well before the current limiting action of the body coil becomes fully effective and further increases in the tip coil temperature are thereby limited.

* * * * *